US006105658A

United States Patent [19]

Baumgartner

[11] Patent Number: 6,105,658

[45] Date of Patent: Aug. 22, 2000

[54] PROCESS AND DEVICE FOR FILLING A CASTING TOOL WITH A METAL MELT

[75] Inventor: Heinrich Baumgartner, Schiltach, Germany

[73] Assignee: BBS Kraftfahrzeugtechnik AG, Germany

[21] Appl. No.: 09/029,791

[22] PCT Filed: Aug. 14, 1996

[86] PCT No.: PCT/DE96/01544

§ 371 Date: Jun. 15, 1998

§ 102(e) Date: Jun. 15, 1998

[87] PCT Pub. No.: WO97/09137

PCT Pub. Date: Mar. 13, 1997

[30] Foreign Application Priority Data

Sep. 9, 1995 [DE] Germany ..... 195 33 447

[51] Int. Cl.[7] ..... B22D 17/12

[52] U.S. Cl. ..... 164/113; 164/133

[58] Field of Search ..... 164/133, 120, 164/113, 312, 316

[56] References Cited

U.S. PATENT DOCUMENTS

| | | | |
|---|---|---|---|
| 5,263,531 | 11/1993 | Drury et al. | 164/120 |
| 5,320,160 | 6/1994 | Kato et al. | 164/305 |
| 5,527,101 | 6/1996 | Kato et al. | 164/126 |
| 5,810,068 | 9/1998 | Kato | 164/306 |
| 5,913,353 | 6/1999 | Riley et al. | 164/113 |

FOREIGN PATENT DOCUMENTS

| | | |
|---|---|---|
| 0 356 736 | 3/1990 | European Pat. Off. . |
| 1 302 161 | 5/1970 | Germany . |
| 1 290 672 | 3/1971 | Germany . |
| 54-115 628 | 9/1979 | Japan . |

OTHER PUBLICATIONS

*Giesserei Lexikon*, Published by Ernst Brunhuber, 1983, Fachverlag Schiele & Schön GmbH, Berlin pp. 4–41. Basis: General Background on Casting Techniques.

*Primary Examiner*—Kuang Y. Lin
*Attorney, Agent, or Firm*—Dick & Harris

[57] ABSTRACT

In order to fill a casting mould with a molten metal, the latter is caused to flow into through an annular chamber into the shaped cavity of a casting mould, such annular chamber discharging over the entire external periphery of the shaped cavity into the latter. The inflow of molten metal into the annular chamber is interrupted by means of a piston, which, being borne inside the annular chamber, is capable of sliding therein. The molten metal can be caused to flow across a large flow cross-section, which shortens the filling time even with reduced flow velocity.

12 Claims, 1 Drawing Sheet

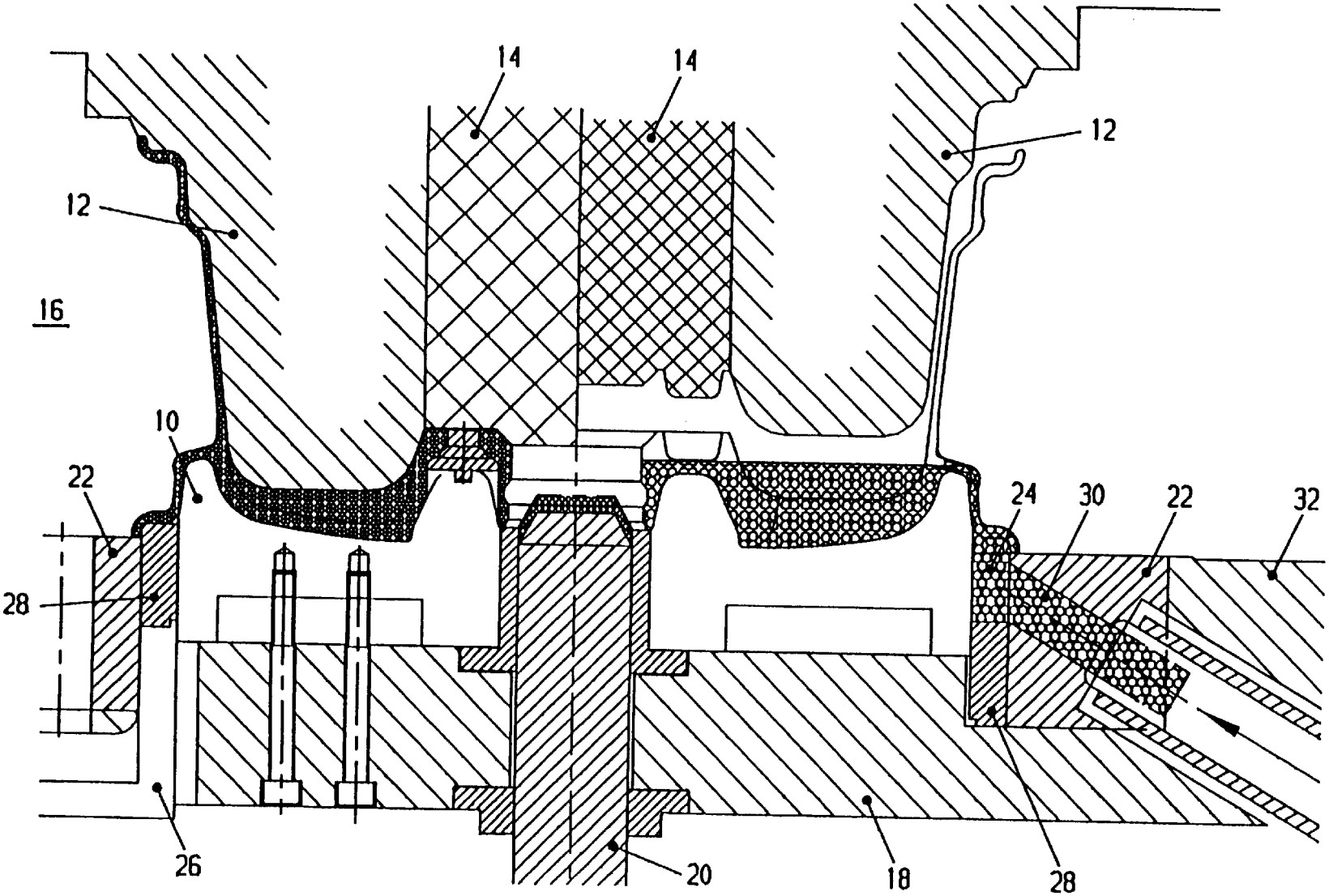
32
22
30
24
12
28
18
14
14
20
12
10
22
26
28
16

PROCESS AND DEVICE FOR FILLING A CASTING TOOL WITH A METAL MELT

BACKGROUND OF THE INVENTION

The invention relates to a process and a device for filling a casting mould with a molten metal.

The pouring of castings, whose diameter exceeds their axial length, e.g. dynamically-balanced castings such as light-alloy castings for vehicles, requires in most cases the use of a central downsprue, through which the molten metal flows into the centre of the shaped cavity of the casting mould. In addition, lateral and multiple in-gates are employed. Common to all of these processes is that the molten metal is delivered through a feed channel of relatively small diameter, approx. 30 mm to 50 mm. In order for the molten metal to be able to flow reliably from this downsprue to all areas of the shaped cavity of the casting mould before hardening, the molten fluid metal must be kept at a high temperature. This results in high build-up of heat in the feed region, the result of which in turn being a partial overheating of the casting mould in the downsprue region. Such overheating causes the downsprue linings to wear significantly, which reduces the service life of the casting mould. The high temperature of the molten metal, moreover, lengthens the cooling cycle, the result of which as a rule being the employment of expensive additional cooling procedures.

The object of the invention is to improve the filling of a casting mould with a molten metal so as to both reduce cycle times and improve casting quality.

Japanese reference JP 54 115 628 A discloses that molten metal is first fed decentrally into an annular chamber. The annular chamber is connected along its circumference to the shaped cavity of the casting mould in such a way that the molten metal flowing from the annular chamber into the shaped cavity can be evenly distributed along the circumference. This arrangement is supposed to reduce turbulent flow in the molten metal, which in turn reduces gas pocket development in the finished product. There remains the problem, however, that the molten metal flows relatively slowly into the shaped cavity, so that the molten, fluid metal must be maintained at a high temperature, which entails the aforementioned disadvantages.

It is proposed that this object can be achieved through the process and apparatus of the present invention.

SUMMARY OF THE INVENTION

The idea underlying the invention comprises that the molten metal be forced out of the annular chamber into the shaped cavity by means of a piston, that is housed inside the annular chamber so as to be able to slide. This arrangement ensures that further inflow of molten metal will be prevented at the end of the filling cycle. The molten metal is pushed by means of the piston, ahead of the latter and forced out of the annular chamber into the shaped cavity.

This arrangement allows molten metal delivery without turbulence, which reduces bubble development and so improves the quality of the casting. In addition, the annular, decentralized inflow of molten metal provides for the distribution of heat via the molten metal over the entire circumference of the annular chamber. The more even distribution of heat prevents localized overheating, which can lead to particularly strong wear on the casting mould. In addition, the faster inflow of molten metal, together with shorter flow distances for the molten metal inside the shaped cavity enable reduction of the temperature of the delivered molten metal. This permits a further reduction of wear as well as energy savings. Finally, the molten metal is permitted to harden more quickly, which, on the one hand, permits additional shortening of the overall cycle time as well as a reduction in dendritic growth, the result of which is improved mechanical characteristics following from shorter dendritic propagation.

The annular chamber is provided with at least one piston, which can be pressed into the volume contained inside the annular chamber. In this arrangement, this piston closes off the feed channel for the molten metal and pushes the molten metal remaining inside the annular chamber into the shaped cavity.

Both the process and the device can, advantageously, be used in the production of dynamically-balanced cast parts, for example in the manufacture of light-alloy wheels for vehicles.

Both process and device can be employed in conjunction with all known pressurized casting processes, more particularly in conjunction with low-pressure casting machines, counter-pressure machines, press-casting machines employing the "squeeze effect" and vacuum-casting machines.

The invention will next be described in greater detail by means of the embodiment examples illustrated in the drawing. The sole figure in the drawing shows, in axial section, the casting of a light-alloy wheel for a vehicle,wherein the right-hand half illustrates the arrangement using an open casting, mould and the left-hand half the arrangement using a closed casting mould.

BRIEF DESCRIPTION OF THE DRAWING

The drawing illustrates the production of a light-alloy wheel for a powered vehicle.

The casting mould comprises a steel casing constructed of a lower mould part 10, an upper mould part 12 with a central insert 14 and pushers 16. Lower mould part 10 is rigidly mounted upon a base plate 18. Upper mould part 12 and its central insert 14 can move vertically. Upper mould part 12 can, if necessary, be designed in one piece together with central insert 14. Inserted through base plate 18 and lower mould part 10 is a lifting rod 20.

DESCRIPTION OF THE PREFERRED EMBODIMENT

Mounted on base plate 18 is a stop ring 22, which coaxially surrounds lower mould part 10. Stop ring 22 is arranged radially at a distance from the outer periphery of lower mould part 10, so as to form a cylindrical annular chamber 24 between on the one side the outer periphery of lower mould part 10 and a shoulder of base plate 18 that connects axially thereto and on the other side the inner periphery of stop ring 22. Annular chamber 24 is closed off on its floor side by means of base plate 18, whereby a fluid pressure channel 26 leads through base plate 18 from beneath into annular chamber 24. Housed down inside annular chamber 24 is an annular piston 28, which consumes the entire horizontal cross-section of annular chamber 24 while taking up half the axial height of annular chamber 24. Piston 28 is arranged inside annular chamber 24 in such a way as to be capable of sliding snugly against the latter on both its inner and outer circumferences. Piston 28 can, by means of pressure applied via fluid pressure channel 26, be pushed upwards inside annular chamber 24. Piston 28 can, alternatively, be pushed upwards by means of a plurality of hydraulically-actuated lifting rods.

A feed channel 30 leads through stop ring 22 above piston 28 into annular chamber 24. Feed channel 30 runs radially through stop ring 22 and rises axially from the outside to the inside. At the radial outer end of feed channel 30, an inflow pipe 32, which is pressurized by means of a pressure piston, is inserted snugly and frictionally by means of a concave-shaped mouthpiece into the stop ring.

Annular chamber 24 opens at its upper end over its entire periphery and over its entire radial width into the shaped cavity of the casting mould at the outer periphery thereof. In the embodiment example shown in the drawing, wherein the casting is a vehicle wheel, annular chamber 24 opens into the region of the shaped cavity, formed by lower casting mould 10 and pushers 16, that constitutes the outer rim beak of the wheel.

The casting process takes place as follows:

First, upper mould part 12 together with central insert 14 is in its raised upper position while piston 28 is seated down inside annular chamber 24, as illustrated in the right-hand half of the drawing. The molten metal is fed radially from the outside via inflow pipe 32 and feed channel 30 into annular chamber 24 above piston 28. The molten metal fills annular chamber 24 as well as the shaped cavity of lower mould part 10, whereby the molten metal reaches its characteristic pool depth inside lower mould part 10. The feed rate of the quantity of the periphery while laminar flow is facilitated in the molten metal flowing into annular chamber 24.

Instead of a single feed channel 30, a plurality of feed channels can be disposed on the periphery of annular chamber 24.

Piston 28 can be designed in one piece as a closed annular body. It is also possible to subdivide piston 28 by means of one or more radial joints, which permit piston 28 to expand thermally toward the periphery.

Piston 28 can, moreover, be subdivided into a plurality (preferably 2) of annular bodies which, capable of being nested coaxially and sliding axially one relative to another, can be pressure-loaded and moved separately one from another. The outer annular body is slid first, in order to close off feed channel 30 and interrupt delivery of molten metal. The inner annular body then forces the molten metal out of annular chamber 24 into the shaped cavity and, in particular, acts to compress the molten metal in the region of the downsprue.

It is clear that annular chamber 24 need not discharge freely over its entire periphery into the shaped cavity. What is important, however, is that there must exist as large an inflow cross-section as possible between annular chamber 24 and the shaped cavity.

It will furthermore be appreciated that annular chamber 24 need not necessarily discharge at the outer periphery of the shaped cavity, but rather also be capable of discharging into a radially-central region. The area in which annular chamber 24 discharges into the shaped cavity is, of necessity, determined by the shape of the casting itself. The further towards the outside in the radial direction annular chamber 24 is arranged, the greater the inflow cross-section and thus the greater use that can be made of the proposed advantages.

annular chamber 24 need not have a dynamically-balanced shape, but can, rather, for example, have a polygonal shape. In such an arrangement, the piston is subdivided into individual piston bodies, which correspond to the individual sides of the polygon.

The proposed process can also be applied to non-dynamically-balance castings.

List of illustration captions

10 lower mould part
12 upper mould part
14 central insert
16 pusher
18 base plate
20 lifting rod
22 stop ring
24 annular chamber
26 fluid pressure channel
28 piston
30 feed channel
32 inflow pipe

What is claimed is:

1. A process for filling a casting mould with a molten metal, wherein the process comprises the steps of:

providing a casting mould having a shaped cavity;

providing an annular chamber (24) that is connected in fluid communication, over at least a majority of its circumference, to the shaped cavity of the casting mould;

providing at least one feed channel (30), arranged decentrally to the shaped cavity of the casting mould, for supplying molten metal to the annular chamber (24);

providing at least one arcuate annular piston (28), slidable within the annular chamber (24), between a position blocking access from the at least one feed channel (30) to the annular chamber (24), and a position enabling access from the at least one feed channel (30) to the annular chamber (24);

feeding molten metal into the annular chamber (24);

interrupting the feeding of molten metal into the annular chamber (24), by sliding the at least one arcuate annular piston (28) within the annular chamber (24), the at least one arcuate annular piston (28) forcing the molten metal out of the annular chamber (24), into the shaped cavity.

2. An apparatus for filling a casting mould, having a shaped cavity, with a molten metal, comprising:

an annular chamber (24) that is connected in fluid communication, over at least a majority of its circumference, to the shaped cavity of the casting mould;

at least one feed channel (30), arranged decentrally to the shaped cavity of the casting mould, for supplying molten metal to the annular chamber (24);

at least one arcuate annular piston (28), slidable within the annular chamber (24), between a position blocking access from the at least one feed channel (30) to the annular chamber (24), and a position enabling access from the at least one feed channel (30) to the annular chamber (24).

3. The apparatus for filling a casting mould, having a shaped cavity, with a molten metal, according to claim 2, further comprising:

the at least one arcuate annular piston (28) being operably configured so that when molten metal is present in the annular chamber (24), and the at least one arcuate annular piston (28) slides from the position enabling access from the at least one feed channel (30) to the annular chamber (24) to the position blocking access from the at least one feed channel (30) to the annular chamber (24), molten metal present in the annular chamber (24) is pushed into the shaped cavity of the casting mould.

4. The apparatus for filling a casting mould, having a shaped cavity, with a molten metal, according to claim 2, wherein:

the annular chamber (24) is arranged on at least a portion of an outer circumference of the shaped cavity of the casting mould and connected, in a conforming manner, to at least a portion of the external contour of the shaped cavity of the casting mould.

5. The apparatus for filling a casting mould, having a shaped cavity, with a molten metal, according to claim 2, wherein:

the annular chamber (24) is arranged about, and in fluid communication with, the entirety of an outer circumference of the shaped cavity of the casting mould.

6. The apparatus for filling a casting mould, having a shaped cavity, with a molten metal, according to claim 2, wherein:

the piston (28) is a closed body extending along the entire circumference of the annular chamber (24) and has a cross-sectional area congruent with the cross-sectional area of the annular chamber (24).

7. The apparatus for filling a casting mould, having a shaped cavity, with a molten metal, according to claim 2, wherein:

the at least one arcuate annular piston (28) is subdivided by at least one radial joint.

8. The apparatus for filling a casting mould, having a shaped cavity, with a molten metal, according to claim 2, wherein:

the at least one arcuate annular piston (28) is subdivided into at least two piston (28) bodies, arranged coaxially relative to one another, and coaxially slidable relative to one another.

9. The apparatus for filling a casting mould, having a shaped cavity, with a molten metal, according to claim 2, wherein:

the annular chamber (24) has a shape of a circular annulus.

10. The apparatus for filling a casting mould, having a shaped cavity, with a molten metal, according to claim 2, wherein:

the annular chamber (24) has a shape of a polygonal annulus.

11. The apparatus for filling a casting mould, having a shaped cavity, with a molten metal, according to claim 9, wherein:

the annular chamber (24) and the at least one arcuate annular piston (28) are configured as right circular cylinders.

12. The apparatus for filling a casting mould, having a shaped cavity, with a molten metal, according to claim 11, wherein:

the annular chamber (24) is disposed to discharge, in fluid communication, to that portion of the shaped cavity for the casting mould that forms the outer rim beak for a wheel being cast.

* * * * *

UNITED STATES PATENT AND TRADEMARK OFFICE

CERTIFICATE OF CORRECTION

PATENT NO. : 6,105,658
DATED : August 22, 2000
INVENTOR(S) : Baumgartner

It is certified that error appears in the above-identified patent and that said Letters Patent is hereby corrected as shown below:

Column 3,
Line 61, delete "annular" and insert therefore -- Annular --.

Signed and Sealed this

Twenty-fourth Day of July, 2001

*Attest:*

Nicholas P. Godici

NICHOLAS P. GODICI
*Acting Director of the United States Patent and Trademark Office*

*Attesting Officer*